US006826127B2

(12) United States Patent
Stekelenburg

(10) Patent No.: US 6,826,127 B2
(45) Date of Patent: Nov. 30, 2004

(54) SETTING STRUCTURE MODULE FOR TIMER

(75) Inventor: Albert Stekelenburg, 9th Fl., 102 Kuang-Fu S. Rd., Taipei (TW)

(73) Assignee: Albert Stekelenburg, Taipei (TW)

( * ) Notice: Subject to any disclaimer, the term of this patent is extended or adjusted under 35 U.S.C. 154(b) by 246 days.

(21) Appl. No.: 10/145,026

(22) Filed: May 15, 2002

(65) Prior Publication Data

US 2003/0214883 A1 Nov. 20, 2003

(51) Int. Cl.[7] ..... G04F 10/00

(52) U.S. Cl. ..... 368/107; 368/187

(58) Field of Search ..... 368/77, 89, 107, 368/185, 187, 223, 110, 112, 224, 233, 234, 276, 242, 295

(56) References Cited

U.S. PATENT DOCUMENTS 4,451,159 A * 5/1984 Tanaka ..... 368/69
5,933,391 A * 8/1999 Uptegraph ..... 368/69
6,570,822 B2 * 5/2003 Stekelenburg ..... 368/107

* cited by examiner

*Primary Examiner*—Tulsidas Patel
*Assistant Examiner*—Thanh S. Phan
(74) *Attorney, Agent, or Firm*—Troxell Law Office PLLC

(57) ABSTRACT

A setting structure module for a timer including a hollow top housing and a bottom housing, and a time setting apparatus positioned in upper portion of the top housing. A middle cover is located above a middle of the top housing and inserted through an inner hole of time setting apparatus. The left inner side of the bottom housing provides a synchronize electric motor, a power supply connecting apparatus and the gear transmission system connected to the output axle of synchronize electric motor. A right inner side of the bottom housing has a switch dial and micro switch.

7 Claims, 3 Drawing Sheets

SETTING STRUCTURE MODULE FOR TIMER

FIELD OF THE INVENTION

The present invention is relating to a timer, specifically to a timer movement having an upper plate and a lower plate.

BACKGROUND OF THE INVENTION

The time setting apparatus of a conventional mechanical timer usually is divided into two types. The first type requires inserting a pin to the pre-opened ON-OFF holes and the second type requires moving a switch dial which is usually located on an outside of a timer plate, either horizontally or vertically. The disadvantage of the first type is that it uses 30 minutes increments and is not available in 15 minutes increments as a unit and the pins are easily lost. Furthermore, the time setting is limited to the number of pins. The disadvantage of the second type is because the switch dial located outside the timer, it is easily broken by an external force and the position may be changed accidentally causing the settings to be changed. Furthermore, the dimension is larger and the structure is always more complicated.

The current mechanical timer provides no operation indication and whether the timer is in operation depends on voice or long time observation.

The conventional mechanical timer cannot adjust the time difference caused by the difference of a micro switch. Therefore, the time is accurate for only 15 minutes plus minus 5%.

The power supply connecting apparatus of current mechanical timer uses synchronize electricity, usually by printing a circuit board, wherein the voltage decrease resistance is more difficult to install and the reliability is poor.

SUMMARY OF THE INVENTION

The purpose of the present invention is providing a timer movement which overcomes the above-mentioned disadvantages and enables a convenient operation for the timer, having an operation indicating dial, a synchronized electricity connecting apparatus and a precising time adjust apparatus.

In order to achieve the purpose, the device adapted by the present invention is a timer movement, which includes a hollow but openable top housing 12 and a bottom housing 13, a time setting apparatus 50 which is positioned in an upper portion of the top housing 12; a middle cover 9 located above a middle of the top housing 12 and inserted through an inner hole of the time setting apparatus 50. A left inner side of the bottom housing 13 provides a synchronized electric motor 16, the power supply connecting apparatus and the gear transmission system which are connected to the output axle of the synchronized electric. A right inner side of the bottom housing 13 has a switch dial 14 and a micro switch 1, characterized in:

The time setting apparatus has a round pan shape and includes a setting pin base 23 mounted on an exterior circumference of a central extrusion of the top housing 12 and turning around the exterior circumference. On a top portion of setting pin base 23 is a dial ring 8 having 96 setting pins 11 located between the outer edge of setting pin base 23 and dialing ring 23 which can slide along an axle direction. The upper surface of the middle cover 9 has an operation indicating needle 10, a lower portion of said operation indicating needle is a cylindrical sleeve into which is inserted the upper portion of first grade transmission 17' of said gear transmission system and through the upper wall of middle cover 9. The top of the operation indicating needle is a same height as the middle cover 9. The power supply connecting apparatus 60 is fixed in one side of the inner chamber of the bottom housing 13 and includes a first electric conducting plate 2, a second electric conducting plate 3 and a third electric conducting plate 6 and a fourth electric conducting plate 7 extending from the outerwall of bottom housing 13. Meanwhile, between the first electric conducting plate 2 and the fourth electric conducting plate 7, and the second electric conducting plate 3 and the third electric conducting plate 6, is welded a first electric resistance 5 and a second electric resistance 4.

The lower cylindrical rod of said turnable setting pin base 23 provides the last grade connecting gear 30 of gear transmission system which can mesh transmission gear 21, the turning speed is 24 hours per turn. An extending plate of setting pin base 23 provides four holes 31, the outer edge provides 96 positioning grooves 32 and under the outer circumference is a protrusion 33.

Under said dialing ring 8 are four vertically extending vertical protrusions 34 which corresponding to the four holes 31 of setting pin base 23. The four protrusions 34 are inserted into the four holes 31 of setting pin base 23 to form the connection between dialing ring 8 and setting pin base 23. The upper outer circumference of dial ring 8 is printed with 24 hour time indicia 35, the lower outer circumference has 96 passage grooves 36 which corresponding to the 96 positioning groove 32 and extend downwardly to form 96 shallow grooves 37.

The setting pin 11 includes: an open groove 38 provided in a middle portion of the setting pin 11 and slideable in the outer circumference of the setting pin base 23. The upper portion of the setting pin 11 vertically provides a moving head 39 which extends through the passage groove 36 and protrudes from the upper surface. The end portion of setting pin 11 provides tail 40 with a shape corresponding to the shallow groove 37 of dial ring 8, the sides of tail can touch with the touching rod 41 which is provided vertically from said switch dial 14.

The switch dial 14 further provides a time setting precise adjustment apparatus. The apparatus includes a micro switch interval switch dial adjust slide 43 mounted and slideable in the upper section of switch dial 14 and an inner side thereof contacts a micro switch touching head 42 that is sloping plane and an outside end has a jaw 44 which meshes with teeth of the upper portion of switch dial 14.

Because the time setting apparatus includes the setting pin base, dial ring and setting pin, the setting pin can slide In a rail between the setting pin base and dial ring, timely pushing switch dial to connect the micro switch. Therefore, the time setting apparatus is more reliable and more convenient to operate. The operation indicating needle can be easily seen. Because there is a micro switch interval switch dial adjust slide, the error or time difference can be effectively adjusted. The accuracy of each interval is increased to 16 minutes plus and minus 1 minute, the setting error is less than 1 minute. Because of the power supply connecting apparatus is composed of four electric conducting plates and two electric resistances and fixed in one side of bottom housing, the power supply connection is simple and reliable.

DESCRIPTION OF THE PREFERRED EMBODIMENT

The detail of the present invention is disclosed hereunder by combining the drawings.

Figure 1:
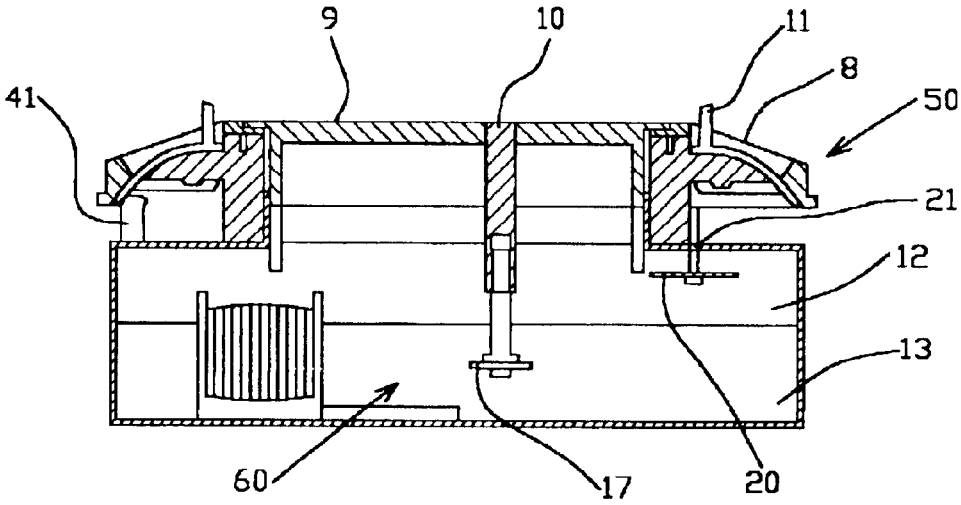
FIG. 1 is the view of overall structure of the timer movement.
Figure 2:
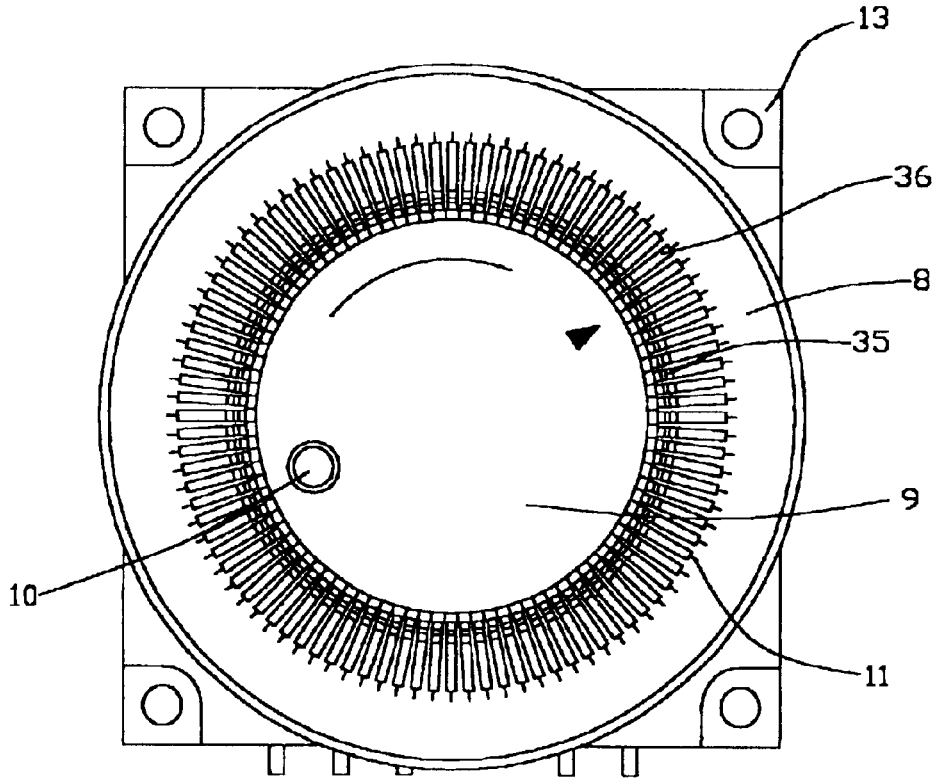
FIG. 2 is the top view of the timer movement.
Figure 3:
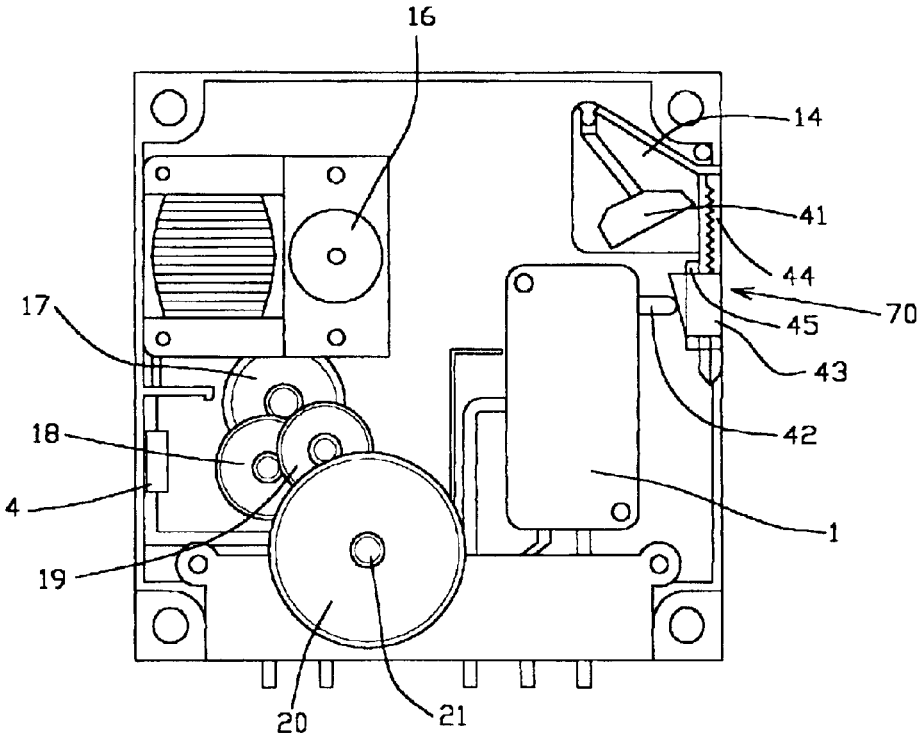
FIG. 3 is the plain view of removing the top housing and locating the transmission system, switch dial and micro switch as well as interval adjustment apparatus.
Figure 4:
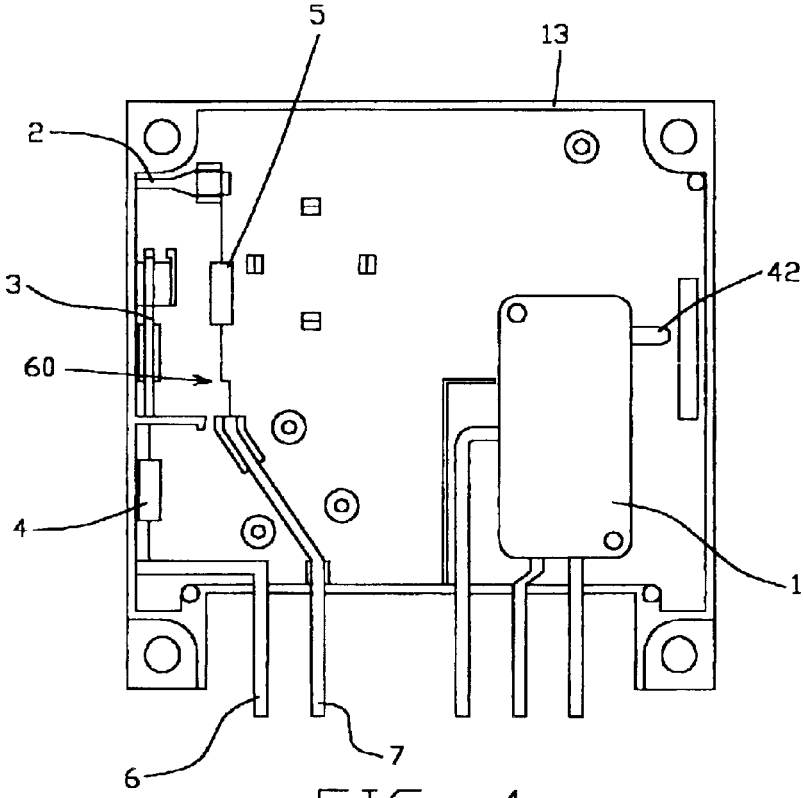
FIG. 4 is the plain view of removing the top housing and locating the power supply connecting apparatus of synchronized electric motor and micro switch.
Figure 5:
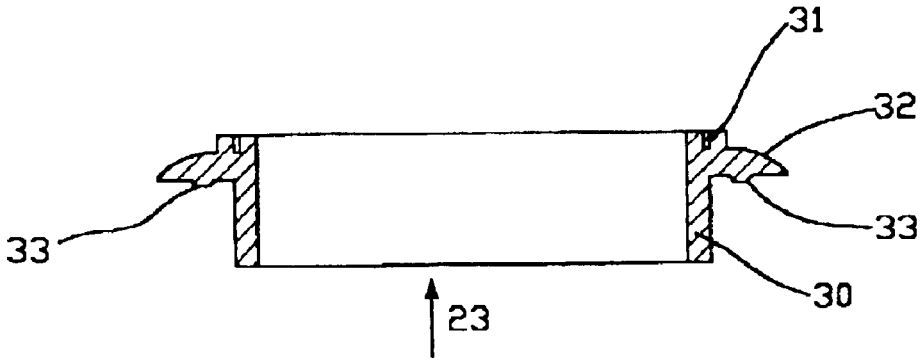
FIG. 5 is the longitude sectional view of setting pin base of the time setting apparatus.
Figure 6:
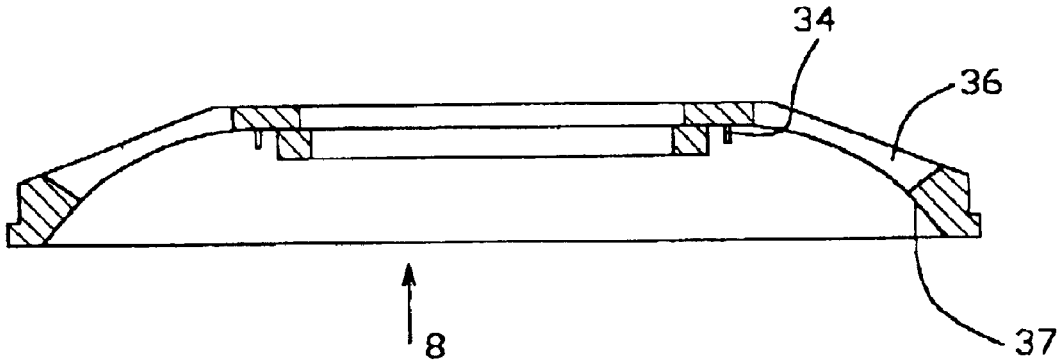
FIG. 6 is the longitude sectional view of dial ring of the time setting apparatus.
Figure 7:
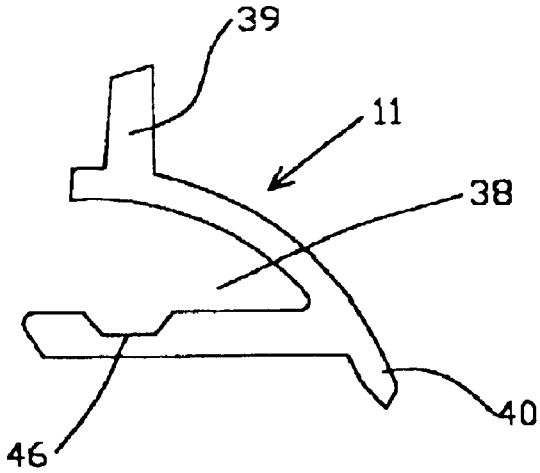
FIG. 7 is the main view of the setting pin of the time setting apparatus.

As shown in FIGS. 1 to 7, the movement of the present invention including a hollow top housing 12 that can be opened or closed, a bottom housing 13, a time setting apparatus 50 which is located in an upper portion of the top housing 12, a middle cover 9 mounted and connected in a middle portion of the top housing 12; the middle cover 9 extruding through an inner hole of the time setting apparatus 50 and a top plane is a top surface of the movement of the present invention. A synchronized electric motor 16 is provided on a left inner side of the bottom housing and has a power supply connecting apparatus, as well as a-gear transmission system which connected with an output axle of the synchronize electric motor 16. A switch dial 14 and a micro switch 1 are located on an interior left side of the bottom housing 13. The time setting apparatus 50 has a round pan shape, includes a setting pin base 23 mounted on an exterior circumference of a central protrusion of the top housing 12 and turning along the exterior circumference. The lower portion of pin base 23 has a cylindrical shape with a last connecting gear 30 for gear transmission system. The connecting gear 30 is meshed with a transmission gear 21 speed is 24 hours per circle. The upper part of pin base 23 provides an extruding plane having four holes 31, a top of the pin base 23 provides 96 positioning grooves 32 which operate as a guide rail, and a lower circumference has a protrusion 33. A dial ring 8 including four small vertical downwardly extending protrusions 34 (refer to FIG. 6) that correspond to the four holes 31 in the pin base 23. By inserting the small protrusions 34 into the four holes 31, the pin base 23 is connected with the dial ring 8. A top circumference of dial ring 8 is printed with 24 hour time indicia 35, a lower outer circumference of the dial ring 8 is printed with 96 passage grooves 36 corresponding to the 96 positioning grooves 32. Extending outwardly from a lower surface of passage groove 36 are 96 shall grooves 37. Between the circumferences of pin base 23 and dial ring 8, there are 96 setting pins 11, which can independently slide along a longitude rail, that means the setting pins 11 are slidably within the passage grooves 36 of the dial ring 8, which is composed of an upper and lower rail. The groove has certain depth and contacting with setting pin 11 side by side, and in addition to positioning also prevents the shaking of the setting pin 11. A middle part of setting pin 11 provides an open groove 38 which can be mounted with pin base 23 and slideable thereon. The top surface of open groove 38 slides along the positioning groove 32 of pin base 23, the bottom surface of the open groove has groove 46 which matches protrusion 33 of setting pin base 23 to enable the setting pin 11 to have flexibility and be stability during the operation. The upper part of setting pin 11 vertically extends a moving head 39 which pass through the passage groove 36 and protrudes from its upper surface. The moving head 39 can be moved by hand and slides along a longitude direction. The end of setting pin 11 has a tail 40 and a shape of an upper surface corresponds to the shallow groove 37 of dial ring 8 and is slidable therein. When moving the moving head 39 by hand the moving head 39 selectively touches the touching rod 41 which upwardly extending from the switch dial to achieve the purpose of time setting. The middle cover 9 of top housing 12 passes through the inner holes of time setting pin base 23 and dial ring 8 and the top plane is the top surface of movement of this timer. The top plane of middle cover 9 provides the operation indicating needle 10 and its lower portion has a cylindrical sleeve which can be mounted to the first transmission gear 17 of said gear transmission system and further pass through and with the same height of middle cover 9. Said synchronize power supply connecting apparatus is fixed in one side of inner chamber of bottom housing 13 (refer to FIG. 1) which including a first conducting plate 2, a second conducting plate 3, and a third conducting plate 6 and fourth conducting plate 7 extending from bottom housing 13. These conducting plates are connected with said synchronize power supply connecting apparatus 60. Furthermore, between the first conducting plate 2 and the fourth conducting plate 7; and the second conducting plate 3 and the third conducting plate 6, there are welded with a first electrical resistance 5 and a second electrical resistance 4, thereby composed a complete synchronize power supply. Beside, there is a time setting precise adjust apparatus 70 (refer to FIG. 3) provided in said switch dial 14, said switch dial 70 including a micro switch interval switch dial adjust slide 43 which is mounted and slideable in switch dial 14. The inner side of the switch dial 70 which contacts the micro switch touching head 42 is a slopping plane and an outside end has a jaw 44 meshed with teeth in an upper section of the switch dial 14 to prevent slide automatically. In order to achieve the purpose of adjust the switch dial adjust slide 43, on the bottom side of bottom housing 13 provided a pass hole 45 corresponding to switch dial adjust slide 43, the switch dial adjust slide 43 can be moved through the pass hole 45. Because the travel interval of the micro switch is inconsistent, the present invention is not using the switch dial 14 to operate directly with the micro switch but through the switch dial adjust slide 43 to adjust the position. In practice, by having the slopping plane of micro switch dial adjust slide 43 contacting with switch touching head 42, the precision of time setting is improved to plus or minus 1 minute.

When practicing, the timer movement of the timer is adjusted by, firstly, moving the setting pin 11 outwardly. Because every pin is 15 minutes the setting time be selected by adjusting a desired number of moving pins to obtain the setting time. This number can be the initial for power supply of turning speed 30 r.p.m. of synchronize electric motor 16. Once the synchronized electric motor is connected to the power supply, the output axle moves the first grade gear 17 and the transmission ratio is 30, then second grade gear 18, third grade gear 19, fourth grade gear 40, and gear 21 are meshed with the last gear 30 of setting pin base 23 which enable the timer apparatus 50 to turn. The outwardly moved and time set tail 40 of setting pin pushes the touching rod 41 of switch dial 14, and through the micro switch dial adjust slide 43 of switch dial 14 pushing the touching head 42 of micro switch and make the connection, to achieve cut off the circuit in preset time interval. Because the transmission ratio of first grade is 30, the turning speed of gear 17 is 1 r.p.m., and the turning speed of the operation indicating needle 10 which mounted on the upwardly extending axle of gear 17 is 1 r.p.m., which is the turning speed of second dial, therefore the timer operate can be viewed directly.

The foregoing description shows only preferred embodiments of the invention, various modifications and alterations of the present invention will be apparent to those skilled in the art without departing from the scope of the invention which is defined by the appended claims. Therefore, the embodiments shown and described are only illustrative, not restrictive.

What is claimed is:

1. A time setting structure for a timer comprising:

a) a top housing having a central protrusion extending from a top thereof;

b) a bottom housing including:

i) a synchronized electric motor located in an interior of the bottom housing;

ii) a power supply connecting apparatus connected to the synchronized electric motor and having first, second, third, and fourth electric conducting plates, a first electric resistance located between the first and the fourth electric conducting plates, and a second electric resistance located between the second and the third electric conducting plates, the third and fourth electric conducting plates extending from a outer wall in the bottom housing;

iii) an a gear transmission system connected to an output axle of the synchronized electric motor;

iv) a micro switch located in an interior of the bottom housing; and v) a switch dial controlling the micro switch;

c) a time setting apparatus located on an upper portion of the top housing and including:

i) a setting pin base rotatably positioned on an outer circumference of the central protrusion of the top housing;

ii) a dial ring located above the setting pin base; and iii) a plurality of setting pins slidably located between the setting pin base and the dial ring; and d) a middle cover inserted into a center hole in the time setting apparatus and having an operation indicating needle protruding from a bottom thereof and connected to a first grade transmission of the gear transmission system.

2. The time setting structure according to claim 1, wherein the setting pin base includes a last grade connecting gear engaging a transmission gear of the gear transmission system and four holes located on a top thereof, the dial ring includes four protrusions extending from a bottom thereof and engaging the four holes of the setting pin base, the transmission gear having a turning speed selected from the group consisting of twenty-four hours per turn and one week per turn.

3. The time setting structure according to claim 1, wherein the setting pin base includes a plurality of positioning grooves and four holes located on a top thereof, the dial ring includes four protrusions extending from a bottom thereof, a plurality of passage grooves and a plurality of shallow grooves located on the bottom thereof and twenty-four hour indicia located on a top thereof, the plurality of passage grooves correspond with the plurality of positioning grooves and extend downwardly to communicate with the shallow grooves, the four protrusions are inserted into the four holes of the setting pin base.

4. The time setting structure according to claim 1, wherein each of the plurality of setting pins includes:

a) an open groove located in a middle portion thereof and slidably engaging an outer circumference of the setting pin base;

b) a moving head protruding from an upper portion thereof and slidably inserted in and protruding through a top of one of the plurality of passage grooves of the dial ring; and c) a tail inserted into one of the plurality of shallow grooves and selectively engaging a touching rod of the switch dial.

5. The time setting structure according to claim 1, wherein the switch dial includes a time setting precise adjustment apparatus includes a micro switch interval switch dial adjust slide slidably connected to an upper section of the switch dial and a jaw meshing with teeth of the switch dial, the micro switch interval switch dial adjust slide selectively engaging a touching head of the micro switch.

6. The time setting structure according to claim 5, wherein the bottom housing includes a pass hole on a bottom thereof corresponding to the micro switch interval switch dial adjust slide.

7. The time setting structure according to claim 1, wherein the synchronized electric motor has a turning speed of thirty revolutions per minute, the first grade gear has a transmission ration of thirty; and the operation indicating needle has a turning speed of one revolution per minute.

* * * * *